US005772172A

United States Patent [19]

Sampedro et al.

[11] Patent Number: 5,772,172

[45] Date of Patent: Jun. 30, 1998

[54] ROTATING ROADSIDE LIGHT POLE ASSEMBLY

[75] Inventors: Pablo S. Sampedro, San Jose; Gordon L. Ritchie, Danville, both of Calif.

[73] Assignee: Lockheed Martin Corporation, Bethesda, Md.

[21] Appl. No.: 607,615

[22] Filed: Feb. 27, 1996

Related U.S. Application Data

[60] Provisional application No. 60/003,205, Sep. 5, 1995.

[51] Int. Cl.[6] ..... F16M 13/00

[52] U.S. Cl. ..... 248/415; 248/548; 248/522; 362/413; 362/431

[58] Field of Search ..... 248/548, 521, 248/522, 415, 418; 52/40, 296, 98; 362/412, 431, 418; 404/10; 175/85; 49/333, 334, 337

[56] References Cited

U.S. PATENT DOCUMENTS 1,234,893 7/1917 Fridley .
2,094,226 9/1937 Wagner ..... 49/333
2,694,540 11/1954 Pfaff, Jr. .
3,521,413 7/1970 Scott et al. ..... 52/98
4,406,094 9/1983 Hempel et al. ..... 52/296 X

*Primary Examiner*—Robert W. Gibson, Jr.
*Assistant Examiner*—Stephen S. Wentsler
*Attorney, Agent, or Firm*—Townsend and Townsend and Crew LLP

[57] ABSTRACT

A roadside standard assembly and maintenance method are provided which facilitate installation, maintenance, and repair of an object suspended over a roadway. The standard assembly comprises a support pole and an arm extending from the pole. The object is supported on the arm, and is normally disposed over a roadway. The standard rotates about the pole, allowing the arm to swing from over the roadway to a roadside position from which the object can be accessed for maintenance without resorting to a road closure. An anchoring structure maintains the upward orientation of the pole, and is optionally retrofittable for existing roadside standard installations.

14 Claims, 5 Drawing Sheets

ROTATING ROADSIDE LIGHT POLE ASSEMBLY

This application is a continuation of U.S. Provisional patent application Ser. No. 60/003,205, filed Sep. 5, 1995, the full disclosure of which is incorporated herein by reference.

BACKGROUND OF THE INVENTION

The present invention relates generally to roadway lighting and signs, and more particularly to a signal or light standard which suspends traffic lights, street lamps, road signs, or the like over a roadway, and which rotates horizontally to provide roadside access for maintenance.

Highways and city streets make extensive use of electrically-powered lighting devices suspended over the roadway. Street lamps, traffic signals, and lighted road signs typically extend at least part way over the roadway to optimize visibility. Generally, these objects are supported by an arm which extends over a traffic lane from a roadside pole, called a "standard."

Unfortunately, all electrical devices require routine maintenance. Replacement of burned out or damaged bulbs, repairing weathered electrical connectors, and the like, are common road maintenance procedures. Field work to install, repair, or maintain overhead objects often requires that traffic be rerouted around the overhead activity. Hence, when a light is suspended over the roadway, maintenance is typically performed by partially or fully closing the roadway below the lighting assembly, and accessing the light from a truck having a personnel lift parked on the roadway. Clearly, the flow the traffic is impeded by this road closure. Additionally, maintenance personnel on or around the lift truck are subjected to significant danger of injury from any remaining traffic.

The cost of installation and maintenance of roadway lighting is raised significantly by road closures. Closing the lane itself typically involves a large number of highly visible cones, barricades, or the like. Special in-lane lift equipment also adds to maintenance costs, and safety equipment generally requires additional labor, which compounds the expense.

For the above reasons, it is desirable to provide roadway lighting assemblies and maintenance procedures which allow regular repairs to the objects supported by roadside standards without the need to resort to a road closure. It is further desirable that such assemblies and methods allow both maintenance and installation of roadside lighting assemblies with a minimal impact on traffic. It would be particularly desirable if existing roadway lighting apparatus could be retrofitted at a reasonable cost to allow roadside maintenance in a safe environment, away from the flow of normal traffic.

SUMMARY OF THE INVENTION

A roadside standard assembly and maintenance method are provided which promote installation, maintenance, and repair of objects which are suspended over a roadway. The standard assembly generally includes a support pole and an arm extending from the pole. The object is supported on the arm, and is normally disposed over a roadway. The standard rotates about the pole, allowing the arm to swing from over the roadway to a roadside position, from which the object can be accessed for maintenance. An anchoring structure maintains the upward orientation of the pole, and is optionally retrofittable for existing roadside standard installations.

In a first aspect, a roadside standard assembly according to the invention comprises a support pole with an arm extending from the pole to support an object. The object is disposed over a roadway adjacent the pole when the object is in use. An anchoring structure rotatably engages the pole, the structure comprising a cylinder which extends upward into the pole to restrain the pole in an upward orientation. An attachment point accepts a moment imposing mechanism to rotate the pole relative to the structure and move the light from over the roadway.

Ideally, the cylinder and the pole form a journal bearing about which the pole rotates. Surprisingly, this simple journal bearing has been found to allow rotation of a roadside standard around a vertical pole with a hand operated winch. Typically, the anchoring structure includes a horizontal bearing plate which supports a weight-bearing surface of the pole. The reliability of the assembly is improved by including steel in the cylinder, pole, plate, and bearing surface, and by providing a layer of grease between the structure and the pole.

The cost of the assembly is minimized by detachably securing the winch to either the pole or the structure, while an associated strap engages a moment arm on the other. Ideally the moment arm is in the form of a cam to provide a controlled rotation. The winch is required only when performing maintenance, and may be removed after maintenance is complete, allowing a single winch to be carried between job sites, and thus minimizing the total capital expenditure.

In another aspect, the invention provides a roadside standard retrofit anchoring structure for use with existing roadside standards. Specifically, the structure will be used with assemblies which include a pole having an arm supporting an object over an adjacent roadway, and having a weight-bearing surface for fastening to a footing. The retrofit structure comprises a body of revolution, typically a cylinder which is insertable within the pole. The cylinder rotationally engages an inner surface of the pole and maintains the pole in a vertical orientation. A horizontal plate is affixed to the cylinder to support the bearing surface of the pole, while a bottom surface allows the structure to be fastened to the footing. The structure also includes an attachment point for attaching a moment imposing mechanism to rotate the pole axially relative to the structure, thereby allowing the light to be moved from over the roadway.

Advantageously, the bottom surface of the anchoring structure and the footing may be joined by a breakaway joint. The use of such breakaway joints greatly improves the survivability of accidents by allowing the base of the standard to shear, rather than imposing a sudden and complete deceleration upon a moving vehicle. In a particularly preferred embodiment, the structure includes an access port which allows access to electrical connections between the light and an underground power supply. Typically, the horizontal plate is releasably fastenable to the bearing surface to prevent unintended rotation of the pole, often using the existing footing bolt pattern.

In another aspect, the invention provides a method for maintaining a roadside standard assembly comprising rotating the assembly about an anchoring structure comprising a body of rotation inserted within a vertical pole of the assembly. The pole has an arm which supports an object over the roadway, and thus swings the object from over the roadway when rotated. Maintenance is then performed on the object, and the maintained object is then repositioned over the roadway. Typically, the pole will be unfastened from the structure prior to rotation, and will be refastened to the structure after repositioning to prevent unintentional rotation of the pole relative to the structure.

A further understanding of the nature and advantages of the invention may be realized by reference to the remaining portions of the specification and the drawings.

DETAILED DESCRIPTION OF THE SPECIFIC EMBODIMENTS

The present invention provides apparatus and methods for maintaining roadside standard without resorting to road closures. The invention provides a simple apparatus and method for rotating over-road equipment to a roadside location, thereby eliminating the labor and traffic congestion of safety detours.

The present invention improves the safety and cost effectiveness of roadside standard repair and maintenance. Initial installation and maintenance of the standard are performed with the arm away from the traffic in a roadside position, providing a safer environment for both the work crew and the driving public. Once the installation or maintenance is completed, the pole is rotated, swinging the arm out over the roadway where it remains during normal operation. As the field equipment and personnel remain roadside throughout the operation, the road need not be closed for overhead activity. It has been estimated that the invention will provide savings of $2000 for each maintenance event by reducing safety detours and the use of special in-lane lift equipment.

Figure 1:
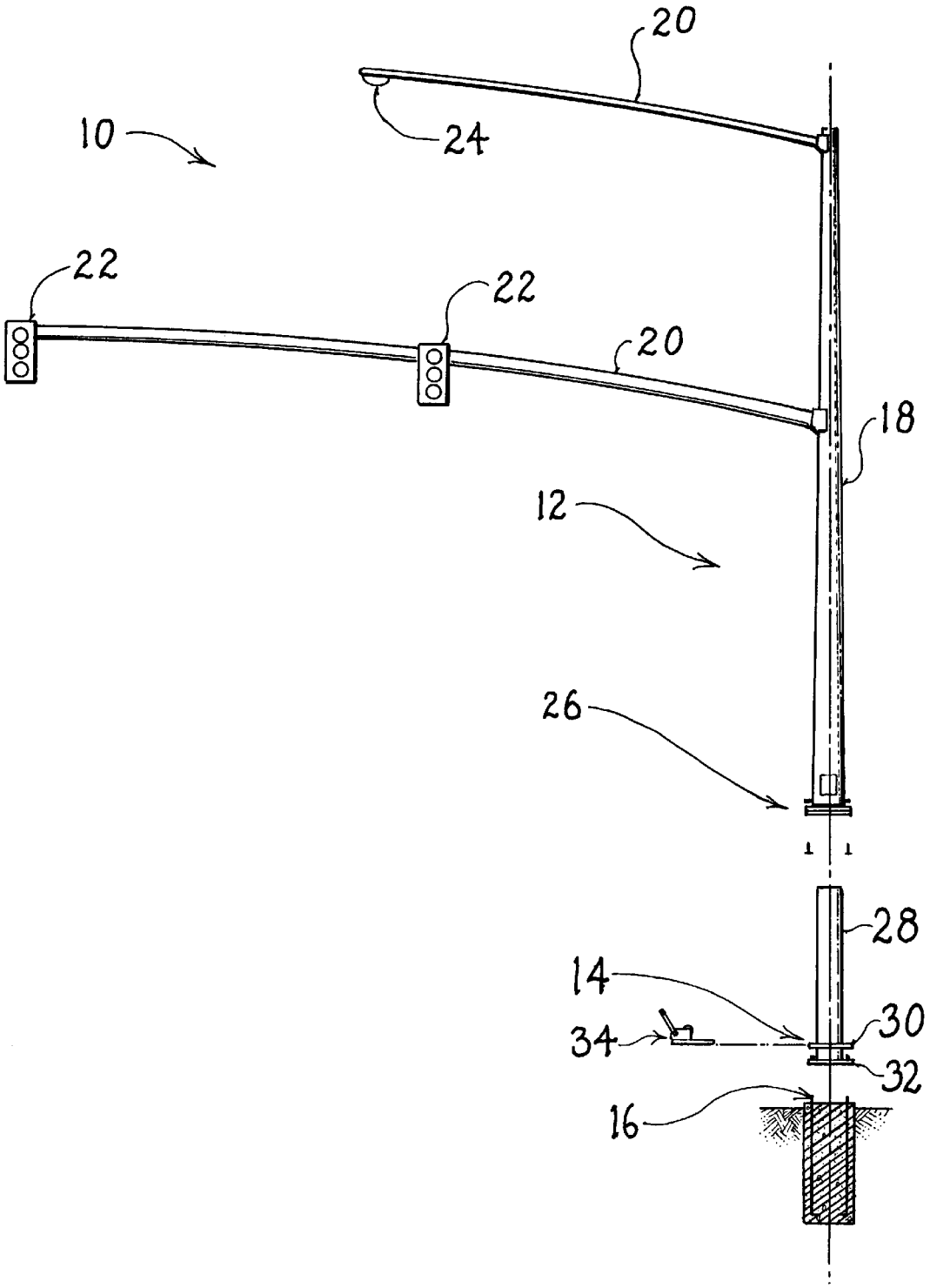
FIG. 1 is an exploded illustration of a roadside standard assembly according to the invention.

Referring now to FIG. 1, an exemplary embodiment of a roadside standard assembly 10 includes an over-road support structure 12, an anchoring structure 14, and a footing 16. Anchoring structure 14 is permanently secured to footing 16, optionally using a breakaway joint. Support assembly 12 is then lowered onto anchoring structure 14, so that the anchoring structure rotatably engages support structure 12 and restrains it in an upward orientation.

Support structure 12 typically comprises a vertical pole 18, which generally comprises a hollow cylindrical steel structure. Pole 18 supports arms 20 which extend over the roadway when support structure 12 is in its operating position. Arms 20, in turn, support traffic signals 22 and a street lamp 24. Alternatively, the arms may be used to support a lighted roadway sign, an electronically controlled traffic indicator, or the like. The invention is particularly advantageous when used with electrically powered objects, but may also find use in maintenance of unpowered road signs and the like.

A cam 26 is bolted to the base of pole 18 to provide a moment arm for rotation of support structure 12. Additionally, the lower surface of cam 26 bears against the anchoring structure 14 to support the weight of the support structure.

Anchoring structure 14 includes a vertically disposed cylinder 28 which is insertable within pole 18 to rotatably engage support structure 12. A horizontal bearing plate 30 engages support structure 12 through cam 26, and a base plate 32 provides attachment to footing 16. A winch 34 is detachably securable to horizontal bearing plate 30 to impose a moment between anchoring structure 14 and support structure 12, thereby facilitating positioning and repositioning of the standard assembly. The most of the assembly is minimized by detachably securing the winch to either the pole or the structure, while an associated strap engages the moment arm (here cam 26) on the other.

Figure 2:
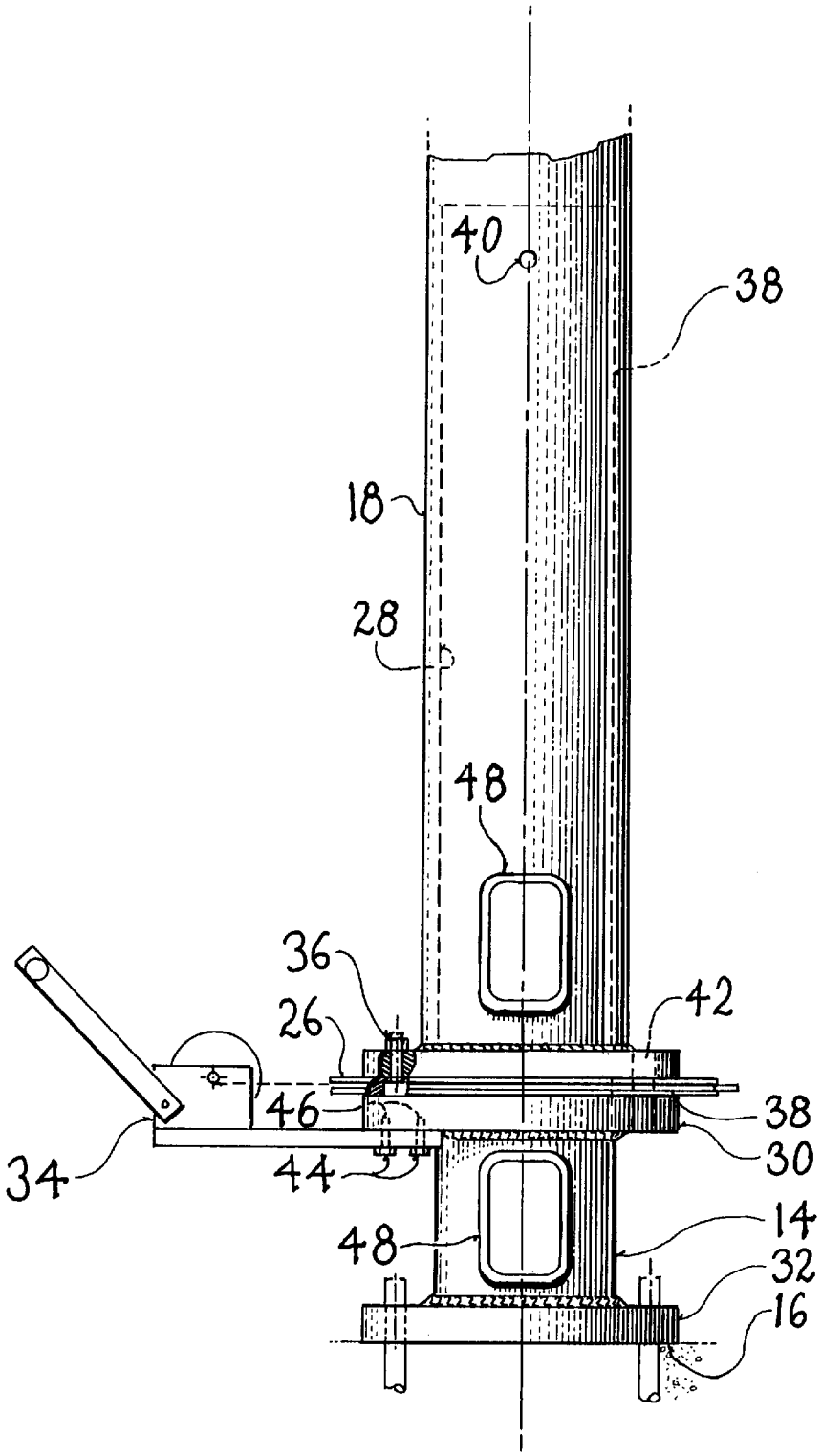
FIG. 2 illustrates a base portion of the roadside standard assembly of FIG. 1, and shows a winch installed in preparation for rotation.

Referring now to FIG. 2, cylinder 28 can be seen inserted within pole 18 to form a simple journal bearing. Cam 26 is bolted to the base of pole 18 using countersunk fasteners 36 to leave an unobstructed lower surface on the cam. This surface rides against horizontal bearing plate 30 during rotation. Preferably, the bearing surfaces of the support and anchoring structures comprise steel, and a layer of grease 38 is disposed between them. Ideally, the grease comprises a long lasting lubricant, such as that used for the prop shafts of ships, and is insertable through grease fittings 40 disposed about pole 18, and through countersunk bolts 36, or the like. Alternatively, a low-friction weight-bearing material may be disposed between the anchoring structure and the pole.

The base of pole 18, cam 26, and horizontal bearing plate 30 have mating fastener holes 42 for preventing rotation of the pole relative to anchoring structure 14. The fasteners have been removed, and winch 34 has been attached to anchoring structure 14 by threading bolts 44 into winch attachment points 46. Standard assembly 10 may then be rotated by attachment of a strap between winch 34 and cam 26, as described hereinbelow.

Figure 3:
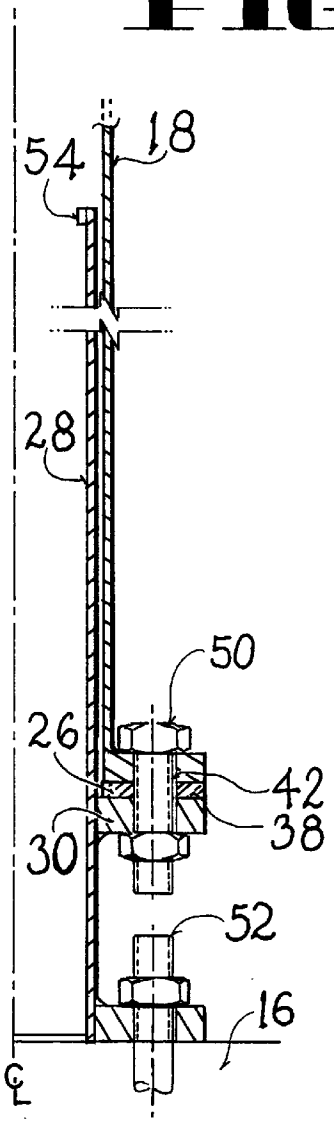
FIG. 3 is a cross-sectional view of a pole and an anchoring structure, as seen in FIG. 2.

To facilitate retrofit of existing light standards with the anchoring structure 14 of the present invention, modifications to the existing light standard should be kept to a minimum. For example, removable fasteners 50 within holes 42 make use of the existing bolt pattern for connection of the base of the lighting standard to tie down bolts 52 of footing 16, as illustrated in FIG. 3. Also, the internal reinforcement ring 54 at the upper end of cylinder 28 does not require modification of pole 18. However, the functionality and accessibility of existing light standards should not be degraded. Existing light standards often include electrical access ports 48 which might be blocked by cylinder 28. To avoid this, anchoring structure 14 also includes electrical access port 48 to provide alternative access for connection of ground power supply wires to the electrical supply system of the light standard. Similarly, to maintain the breakaway capability of the joint between the light standard and the footing, cylinder 28 does not extend down into footing 16, allowing tie down bolts 52 to shear with a predetermined force.

Figure 2A:
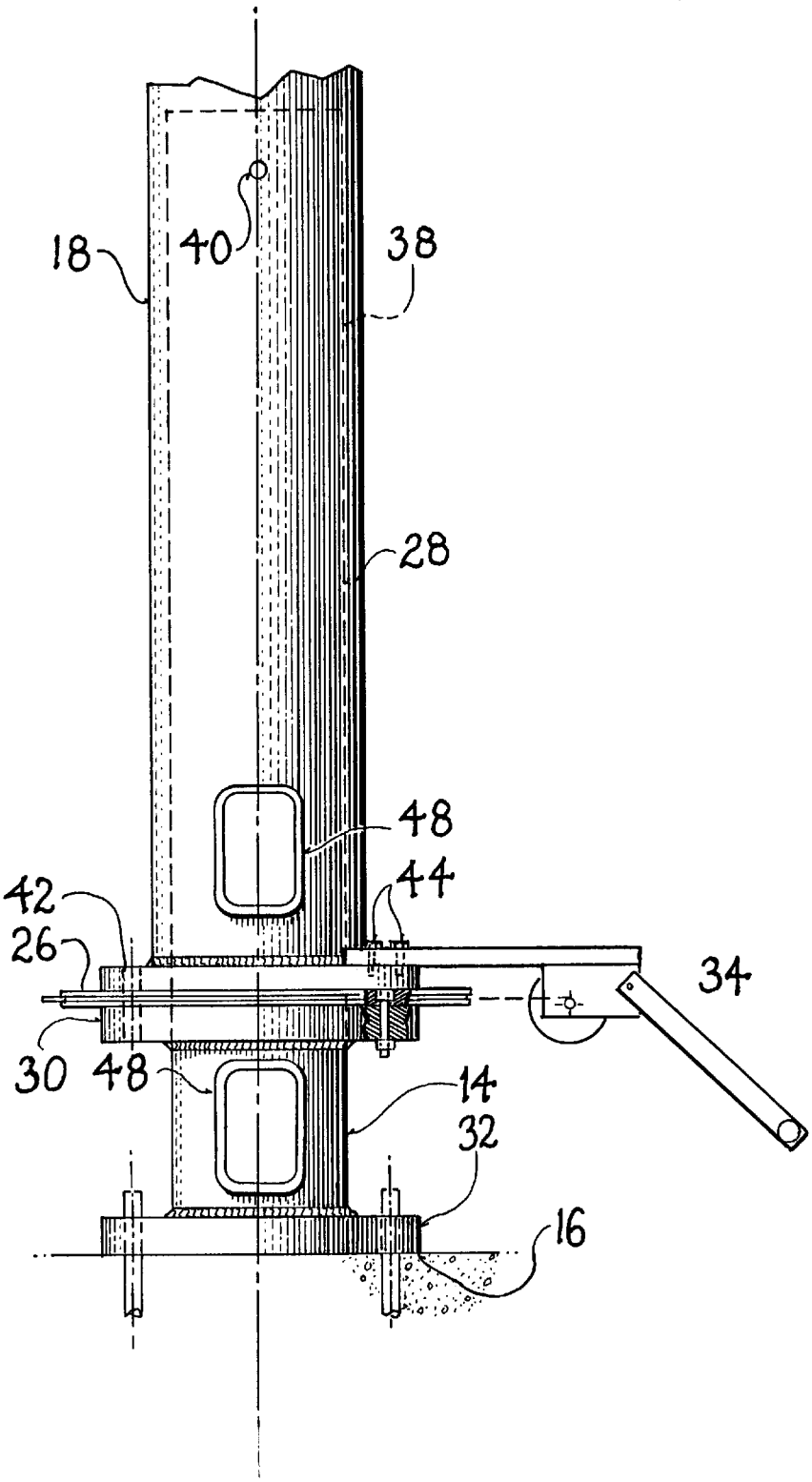
FIG. 2A illustrates a base portion similar to FIG. 2, in which the winch is attached to the pole.
Figure 4:
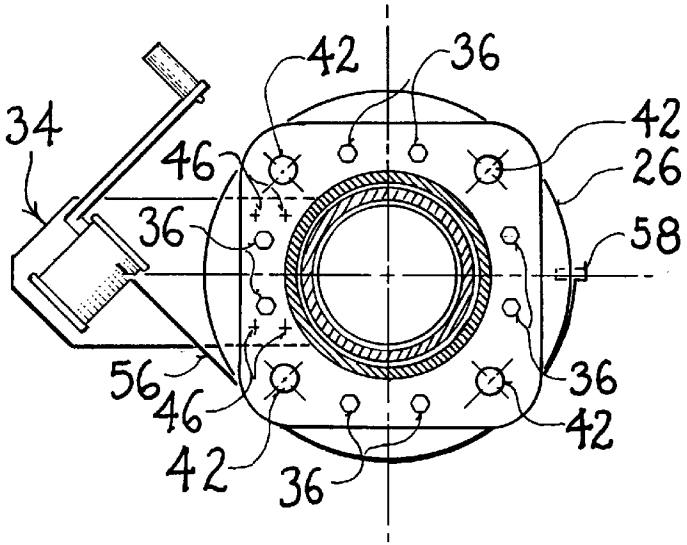
FIG. 4 illustrates the attachment of the winch strap to a cam and the anchoring structure of the standard assembly of FIG. 1.

Referring now to FIG. 4 the bolt patterns for removable fastener holes 42 can be seen. Additionally, the location of countersunk bolts 36 for connection of cam 26 to the base of pole 18, and the bolt pattern for the winch attachment points to the horizontal bearing plate are also indicated. Winch 34 has been attached to the anchoring structure, and strap 56 extends around cam 26 and is detachably secured to pin 58 using a loop located at the end of the strap. The pole is thus ready to turn by cranking winch 34 manually. Surprisingly, a grease-lubricated steel-to-steel journal bearing, as described hereinabove, allows rotation of the pole using forces which can easily be generated by a simple hand-powered winch. Although only a moderate mechanical advantage is actually required to turn the pole, the use of a winch having a substantial mechanical advantage, typically being in the range from 20 to 200, provides a highly controlled safe turning operation with minimal equipment requirements. An alternative arrangement is illustrated in FIG. 2A, in which winch 34 is attached to pole 18 and cam 26 is attached to anchoring structure 14.

Figure 5A:
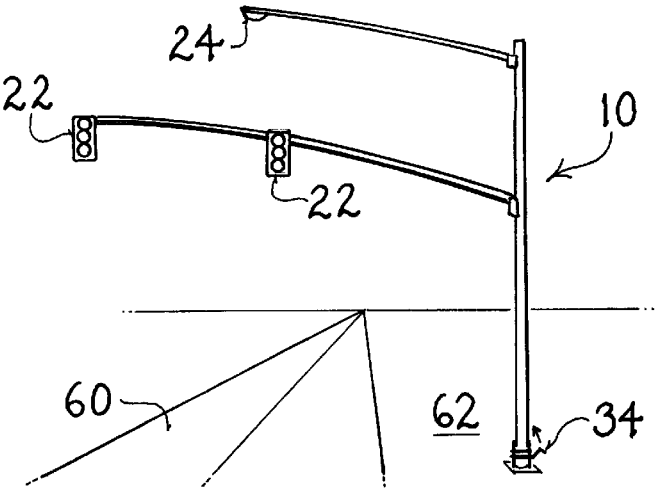
FIGS. 5A–5C illustrate the rotation of the standard assembly of FIG. 1 to allow maintenance on an overhead roadway light without resorting to a road closure, according to the principles of the present invention.
Figure 5B:
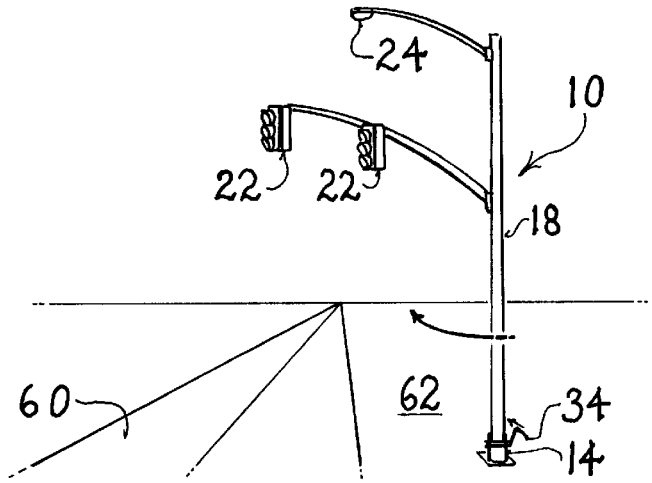
Figure 5C:
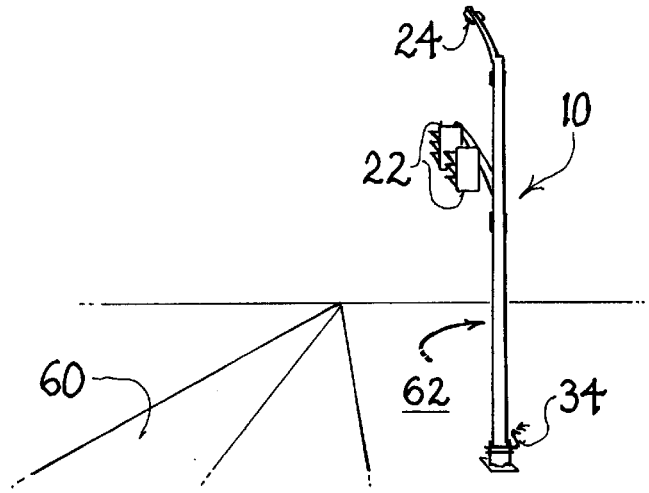

The use of the invention will be described with reference to FIGS. 5A–5C. Initially, signals 22 and street lamp 24 are disposed over the roadway 60. As described hereinabove, removable fasteners 50 have been removed and winch 34 has been attached to the anchoring structure. The winch handle is manually cranked to rotate pole 18 about anchoring structure 14. This may be done from the safety of roadside 62. Optionally, one or more of the removable fasteners 50 are then temporarily inserted to lock the lighting standard in position over the roadside.

The maintenance work, such as replacing a burned-out bulb or repairing weathered wiring, may then be performed from the roadside 62 using a standard lift truck. No road closure is required during this operation. Strap 56 is then removed from pin 58 and wrapped around cam 26 with an opposite rotation. The winch should be reoriented to direct tension along the new orientation of strap 56, either by allowing the winch to pivot about its attachment plate, by having the winch drum in a vertical orientation, or the like. If a removable fastener has been used as a temporary lock, it is removed and the winch cranked to reposition standard assembly 10 to its initial operating position. Removable fasteners 50 are replaced and tightened to prevent unintentional rotation of pole 18. Optionally, additional grease is added using the described grease fittings at some time during each maintenance operation.

In conclusion, the present invention allows the maintenance of overhead roadway signs and lighting apparatus from a safe roadside location. While the above is a complete description of the preferred embodiment of the invention, various alternatives, modifications, and equivalents may be used. Therefore, the above description should not be taken as limiting the scope of the invention, which is instead defined solely by the appended claims.

What is claimed is:

1. A roadside standard assembly for use adjacent to a roadway, the assembly comprising;

a support pole having a lower end and an inner surface which defines an opening extending upward from the lower end;

an arm extending from the pole;

an object supported by the arm, the object disposable over the roadway when the object is in use;

an anchoring structure rotatably engaging the pole, the structure comprising a cylinder extending upward into the opening of the pole, the cylinder engaging the inner surface of the pole to restrain the pole in an upward orientation; and an attachment point disposed on one of the pole and the structure, the attachment point for attaching a moment imposing mechanism to rotate the pole relative to the structure and move the object from over the roadway, wherein the cylinder extends above the attachment point.

2. The assembly according to claim 1, wherein the cylinder and the pole form a journal bearing.

3. The assembly according to claim 2, wherein the structure further comprises a horizontal bearing plate supporting a weight-bearing surface of the pole.

4. The assembly according to claim 3, wherein the cylinder, pole, plate, and bearing surface comprise steel, and further comprising a grease layer between the structure and the pole.

5. The assembly according to claim 1, further comprising releasable fasteners which are releasably fastenable to the pole and the structure for preventing rotation of the pole relative to the structure.

6. The assembly according to claim 1, wherein the structure is secured to a footing using a breakaway joint.

7. The assembly according to claim 6, wherein the structure includes an access port for accessing an electrical connection between the object and an underground power supply.

8. A roadside standard assembly for use adjacent to a roadway, the assembly comprising:

a support pole;

an arm extending from the pole;

an object supported by the arm, the object disposable over the roadway when the object is in use;

an anchoring structure rotatable engaging the pole, the structure comprising a cylinder extending upward into the pole to restrain the pole in an upward orientation;

a cam affixed to one of the pole and the structure;

a moment imposing mechanism comprising a winch having a mechanical advantage, the winch being detachably secured to the other of the pole and the structure and having a strap secured to the cam for applying torque between the structure and the pole to rotate the pole relative to the structure and move the object from over the roadway.

9. A retrofit anchoring structure for use with a roadside standard assembly adjacent a roadway, the assembly including a pole with an arm supporting an object over the roadway and a weight-bearing surface adapted for fastening to a footing, the structure comprising:

a cylinder insertable within the pole for rotationally engaging an inner surface of the pole and maintaining the pole in a vertical orientation;

a horizontal plate affixed to the cylinder for supporting the bearing surface of the pole;

a bottom surface affixed to the cylinder for fastening to the footing in place of the bearing surface of the pole; and an attachment point affixed to the horizontal plate for attaching a moment imposing mechanism to rotate the pole axially relative to the structure and move the object from over the roadway.

10. The structure according to claim 9, wherein the cylinder and the pole form a journal bearing.

11. A structure according to claim 9, wherein the bottom surface forms a breakaway joint when fastened to the footing.

12. The structure according to claim 9, wherein the structure includes an access port for accessing an electrical connection between the object and an underground power supply.

13. The structure according to claim 9, wherein the horizontal plate is releasably fastenable to the bearing surface to prevent unintended rotation of the pole.

14. A method for maintaining a roadside standard assembly comprising:

detachably securing a moment imposing mechanism to one of a pole and an anchoring structure;

rotating the assembly about the pole by turning the pole about a cylinder extending upward into the pole so as to swing an object from a normal position over a roadway, the pole having an arm supporting the object over the roadway, wherein the assembly is rotated by actuating the moment imposing mechanism and actuating a journal bearing formed by the cylinder and the pole;

performing maintenance on the object; and repositioning the maintained object at the normal position;

wherein the moment imposing mechanism comprises a winch, wherein the detachably securing step comprises fastening the winch to one of the pole and the structure and securing a strap to the other of the pole and the structure, and wherein the rotating step comprises manually cranking the winch.

* * * * *